US011078812B2

(12) United States Patent
McCloy

(10) Patent No.: US 11,078,812 B2
(45) Date of Patent: Aug. 3, 2021

(54) CONTINUOUSLY VARIABLE FRICTION DRIVE PHASER

(71) Applicant: BorgWarner Inc., Auburn Hills, MI (US)

(72) Inventor: Chad McCloy, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 872 days.

(21) Appl. No.: 15/744,090

(22) PCT Filed: Jul. 7, 2016

(86) PCT No.: PCT/US2016/041241
§ 371 (c)(1),
(2) Date: Jan. 12, 2018

(87) PCT Pub. No.: WO2017/011256
PCT Pub. Date: Jan. 19, 2017

(65) Prior Publication Data

US 2018/0202327 A1 Jul. 19, 2018

Related U.S. Application Data

(60) Provisional application No. 62/191,660, filed on Jul. 13, 2015.

(51) Int. Cl.
*F01L 1/344* (2006.01)
*F01L 1/047* (2006.01)
(Continued)

(52) U.S. Cl.
CPC ..... *F01L 1/344* (2013.01); *F01L 1/047* (2013.01); *F01L 1/34* (2013.01); *F01L 1/352* (2013.01); *F01L 2800/00* (2013.01)

(58) Field of Classification Search
USPC ..... 123/90.15, 90.17, 90.16, 90.31
See application file for complete search history.

(56) References Cited

U.S. PATENT DOCUMENTS 3,153,938 A 10/1964 De Brie Perry
3,306,119 A 2/1967 De Brie Perry et al.
(Continued)

FOREIGN PATENT DOCUMENTS

GB 979062 A 1/1965
JP 20130509546 A 8/2013
(Continued)

OTHER PUBLICATIONS

International Search Report for PCT/US2016/041241 dated Oct. 17, 2016.

*Primary Examiner* — Patrick Hamo
*Assistant Examiner* — Wesley G Harris
(74) *Attorney, Agent, or Firm* — Brown & Michaels, PC

(57) ABSTRACT

A continuously variable friction drive is used to phase a cam plate attached to the camshaft relative to a sprocket plate driven by the crankshaft. Discs are received within the cavity between the sprocket and cam plate. The discs are free to rotate about an axis of rotation, and is fixed relative to the cam and the sprocket, so that when the sprocket plate rotates, the cam plate is rotated by the discs in the opposite direction. The axis of rotation of the discs can be tilted by an actuator, so that the discs themselves contact the plates at different distances from their axes of rotation, which changes the speed of rotation of one plate relative to the other. When the speed of rotation of the crank and cam differ, the phase angle between the two shafts is changed.

4 Claims, 9 Drawing Sheets

(51) Int. Cl.
*F01L 1/34* (2006.01)
*F01L 1/352* (2006.01)

(56) References Cited

U.S. PATENT DOCUMENTS

| | | | | | |
|---|---|---|---|---|---|
| 3,727,474 | A | | 4/1973 | Fullerton | |
| 4,297,918 | A | * | 11/1981 | Perry | F16H 37/08 475/217 |
| 5,140,864 | A | | 8/1992 | Creed | |
| 5,163,872 | A | | 11/1992 | Niemiec et al. | |
| 5,643,132 | A | * | 7/1997 | Inoue | F16H 61/664 476/10 |
| 5,803,030 | A | * | 9/1998 | Cole | F01L 1/344 123/90.17 |
| 6,047,674 | A | * | 4/2000 | Kadowaki | F02D 13/0207 123/90.15 |
| 6,287,232 | B1 | * | 9/2001 | Sakai | F16H 61/6648 475/216 |
| 6,338,323 | B1 | * | 1/2002 | Machida | F01L 1/34 123/90.15 |
| 6,347,270 | B1 | * | 2/2002 | Takizawa | B60T 8/1755 477/107 |
| 6,351,700 | B1 | * | 2/2002 | Muramoto | B60W 10/02 477/39 |
| 6,457,446 | B1 | * | 10/2002 | Willmot | F01L 1/352 123/90.15 |
| 6,666,791 | B1 | | 12/2003 | Greenwood | |
| 7,077,780 | B2 | | 7/2006 | Yamamoto | |
| 8,721,486 | B2 | | 5/2014 | Murray et al. | |
| 8,920,285 | B2 | | 12/2014 | Smithson et al. | |
| 2002/0166522 | A1 | * | 11/2002 | Takahashi | F01L 1/3442 123/90.15 |
| 2003/0029399 | A1 | * | 2/2003 | Yamamuro | F01L 1/352 123/90.17 |
| 2005/0211207 | A1 | * | 9/2005 | Urushihata | F01L 1/34 123/90.17 |
| 2008/0135004 | A1 | | 6/2008 | Simpson et al. | |
| 2014/0274551 | A1 | | 9/2014 | Younggren et al. | |

FOREIGN PATENT DOCUMENTS

| | | | |
|---|---|---|---|
| WO | 0079150 | A1 | 12/2000 |
| WO | 2010119551 | A1 | 10/2010 |
| WO | 2013110670 | A1 | 8/2013 |
| WO | 2013110920 | A1 | 8/2013 |
| WO | 2015006197 | A1 | 10/2015 |

* cited by examiner

CONTINUOUSLY VARIABLE FRICTION DRIVE PHASER

BACKGROUND OF THE INVENTION

Field of the Invention

The invention pertains to the field of variable cam timing for internal combustion engines. More particularly, the invention pertains to a continuously variable friction drive cam timing device or "phaser".

Description of Related Art

U.S. Pat. No. 3,727,474, discloses an automotive transmission comprising a drive plate and driven plate forming a cavity for receiving discs. The driven plate and driving plate each are contoured to have a half-toroidal friction surface. The center of each of the discs is mechanically linked to a spring loaded carrier present on a drive tube with an axis. The discs are pivotable about a center point. Means, such as weighted balls, are provided for moving the carrier axially on the drive tube and are subjected to centrifugal force and may be manually moved through a control rod.

WO 2013/110920 discloses a continuously variable ratio transmission system with a variator having two input plates and an output plate between the two input plates. The output plate has toroidal recessed output surfaces on opposing faces. On an outer circumference of the output plate are teeth for engagement with a gear of a shaft. The output plate and a first input plate provide a first cavity and the output plate and the second input plate provide a second cavity. Within each of the cavities is a roller. The rollers are mounted in a roller carrier via spherical bearings. The roller carriers are connected together with a cross-bar. A pivot point of each carrier is located midway between the center points of the two spherical bearing which carry the two rollers. The cross-bars each have an actuating arm which is mounted to a mechanical linkage. The mechanical linkage has linking lever for pivoting the carriers through the actuating arms. In an alternate embodiment, the linkage is omitted and each arm is independently actuated by an individual actuator.

The above references are all intended to be used as variable drives, where the point is to have two rotating shafts which rotate at different speeds—a continuously variable transmission for cars, for example.

Variable cam timing or "VCT" is a process that refers to controlling and varying, when desirable, the angular relationship (the "phase") between the drive shaft and one or more camshafts, which control the engine's intake and exhaust valves. In a closed loop VCT system, the system measures the angular displacement, or phase angle, of a camshaft relative to the crankshaft to which it is operatively connected, and then alters the phase angle to adjust various engine characteristics in response to demands for either an increase or a reduction in power. Typically, there is a feedback loop in which the desired values of such engine characteristics are measured against their existing values, and changes are effected inside the engine in response to any variances.

A VCT system includes a cam phasing control device, sometimes referred to as a "phaser", control valves, control valve actuators, and control circuitry. In response to input signals, the phaser adjusts the camshaft to either advance or retard engine timing.

In a VCT system, if the camshaft and crankshaft rotate at different speeds, significant damage of the engine can occur.

SUMMARY OF THE INVENTION

A continuously variable friction drive or phaser which is used to phase a cam plate attached to the camshaft relative to a sprocket plate driven by the crankshaft. Discs are received within the cavity between the sprocket plate and the cam plate. The discs are free to rotate about an axis of rotation, but the disc axis of rotation is fixed relative to the cam and the sprocket, so that when the sprocket plate rotates, the cam plate is rotated by the discs in the opposite direction. When the discs are aligned with the plates' axis of rotation, the two plates rotate at the same speed, in different directions. The axis of rotation of the discs can be tilted by an actuator, such as a ball screw type actuator, so that the discs themselves contact the plates at different distances from their axes of rotation, which changes the speed of rotation of one plate relative to the other. When the speed of rotation of the crank and cam differ, the phase angle between the two shafts is changed.

DETAILED DESCRIPTION OF THE INVENTION

Figure 1:
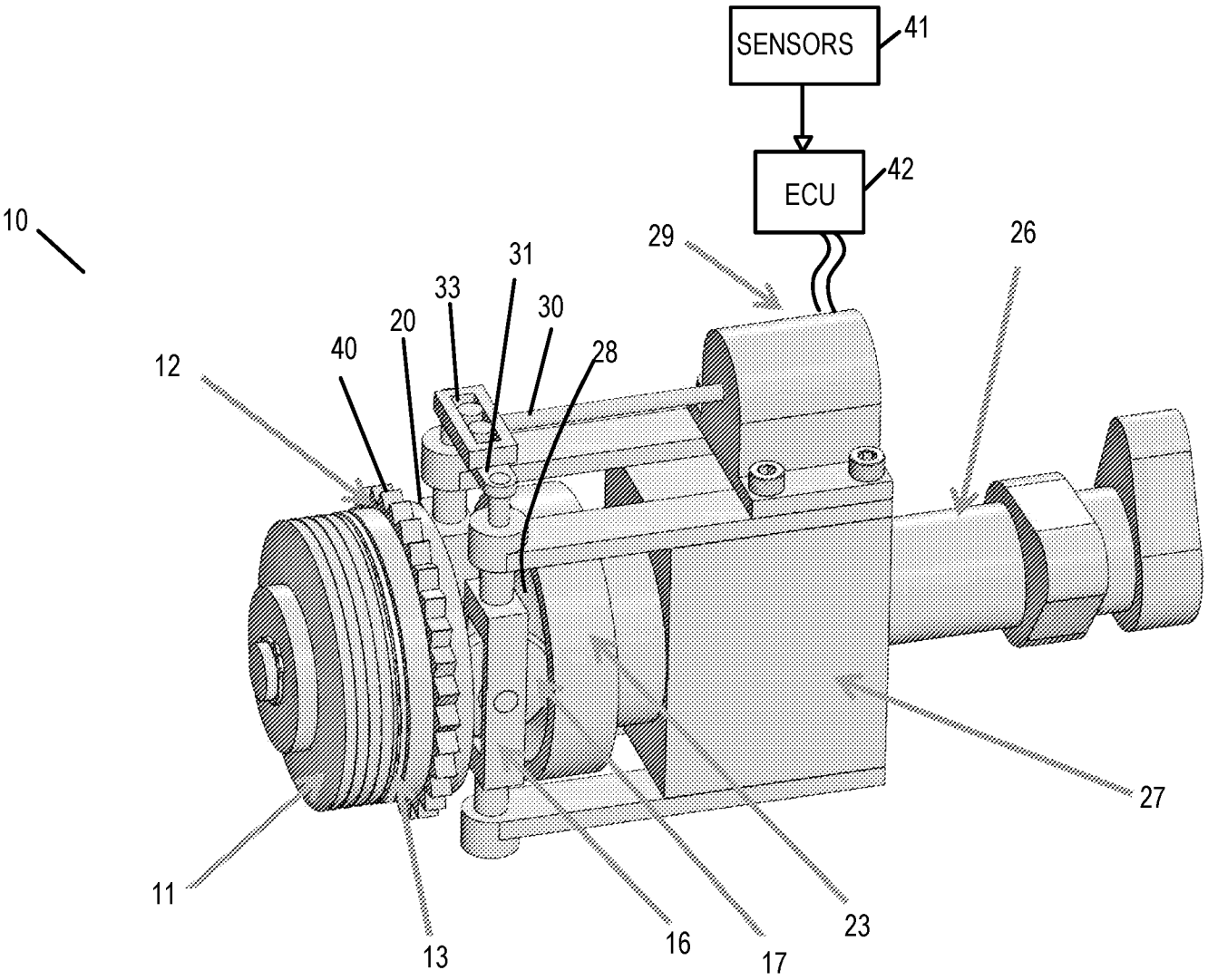
FIG. 1 shows a schematic of a friction drive of the present invention.
Figure 2:
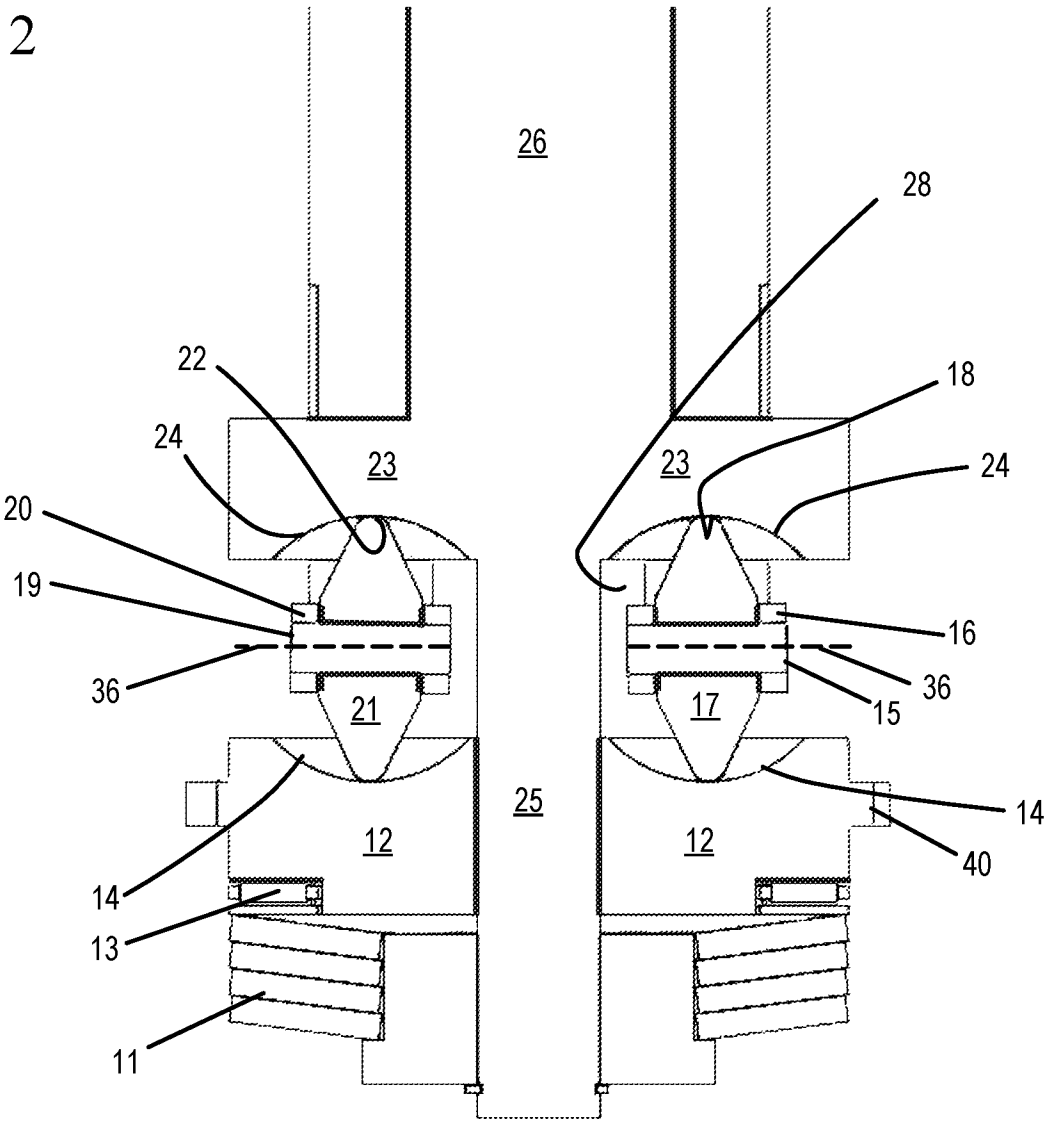
FIG. 2 shows a schematic of a partial section of the friction drive.
Figure 3:
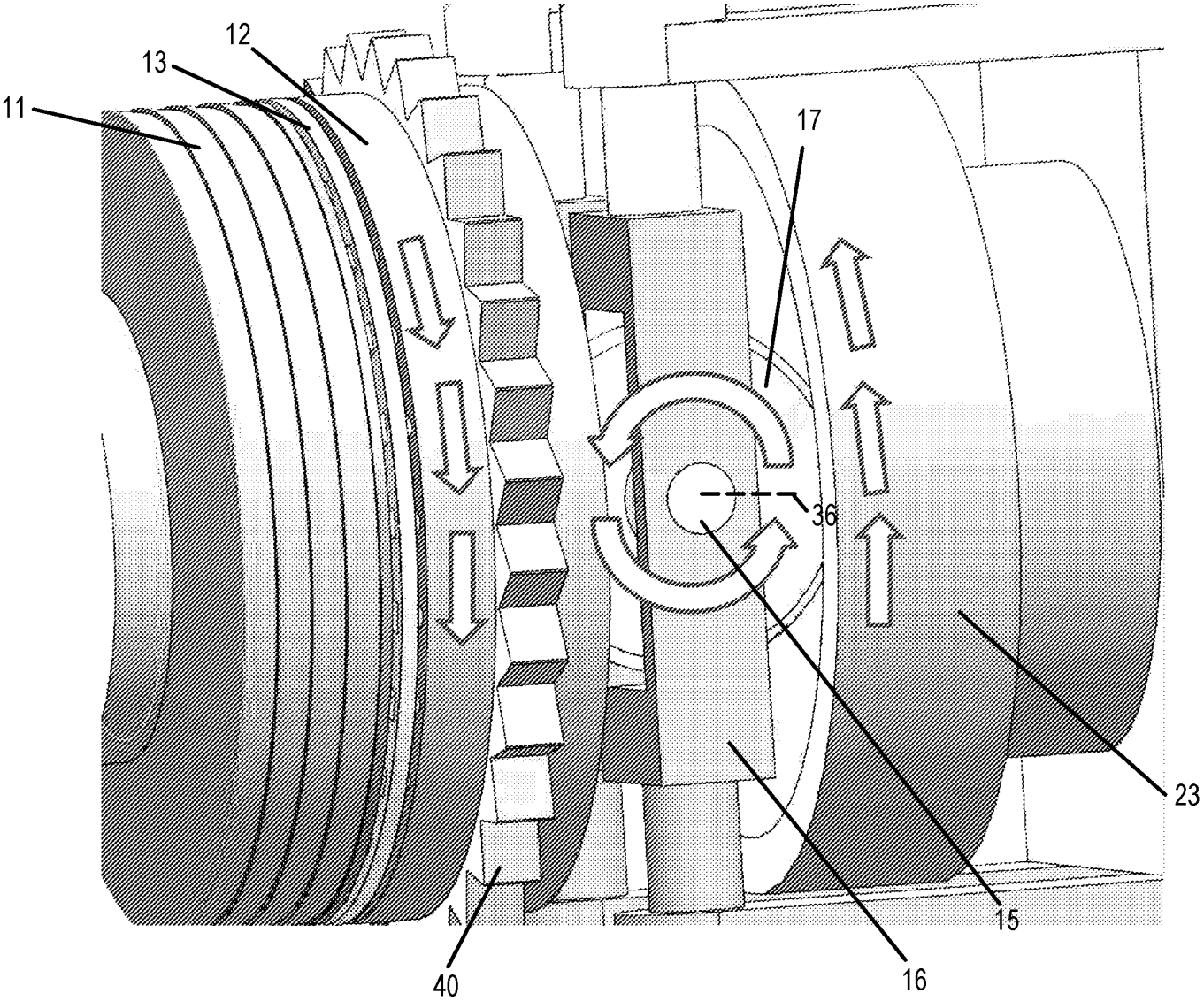
FIG. 3 shows an indication of direction of rotation of the rollers and the cam plate.

FIGS. 1-3 show a continuously variable friction drive or phaser 10 which is used to phase a cam plate 23 attached to the camshaft 26, relative to a sprocket plate 12. The continuously variable friction drive 10 acts as a cam timing phaser by dynamically adjusting the rotational relationship of the camshaft 26 of an internal combustion engine with respect to the crankshaft (not shown). The cam plate 23 may be formed integral with or fixed to the camshaft 26. The sprocket plate 12 is rotatably mounted on a shaft 25 which is an extension of, or bolted to, camshaft 26.

A chain or belt (not shown) connects the sprocket plate 12 to the crankshaft (not shown) through sprocket teeth 40, such that the crankshaft drives the sprocket plate 12 through the sprocket teeth 40. The sprocket plate 12 rotates in a first direction, opposite the direction of rotation of the cam plate 23 as shown in FIG. 3 and indicated by the arrows. The sprocket plate 12 contains an inner surface 14 which is angled or curved and the cam plate 23 also contains an inner surface 24 which is angled or curved. The inner surface 24 of the cam plate 23 is parallel with the inner surface 14 of the sprocket plate 12.

A number of carriers, here shown as first carrier 16 and a second carrier 20, are present in a cavity 28 between the cam plate 23 and the sprocket plate 12. It will be understood that the number of carriers and discs could be two, as shown, or some other number such as three or four or more, within the teachings of the invention.

Each of the carriers 16, 20 contains a disc 17, 21 with an outer circumference 18, 22. The outer circumference 18, 22 of the disc 17, 21 is in contact with the inner surface 14 of the sprocket plate 12 and the inner surface 24 of the cam plate 23. The carrier 16, 20 pivots relative to the cam plate 23 and the sprocket plate 12 to adjust the angle of the disc 17, 21 relative to the inner surfaces 14, 24 of the cam and sprocket plates 12, 23. The carrier 16, 20 is otherwise stationary with respect to the cam bearing 27. The discs 17, 21 rotate about a disc axis 36 on pins 15, 19, which are fixed to carriers 16, 20.

The sprocket plate 12 is biased towards the cam plate 23, biasing the discs 17, 21 into contact with the inner surfaces 14, 24 of the sprocket plate 12 and the cam plate 23. The biasing may be performed by a spring pack 11. A thrust bearing 13 may be present between the spring pack 11 and the sprocket plate 12. Alternatively, the biasing force may be provided by hydraulic means. The friction between the sprocket plate 12 and the discs 17, 21 and the cam plate 23 and the discs 17, 21 limits the slip between the components. Furthermore, the carriers 16, 20, which support the discs 17, 21 are stationary with respect to the head or cam bearing 27 except for rotation to change the angle of the discs 17, 21.

The carriers 16, 20 are mechanically connected to an actuator rod 30 of an actuator 29 via a connector 33 and linkages 31, 32. The actuator 29 actuates the rod 30 and the connector 33 to pivot or rotate the position of the carriers 16, 20 and thus the position of the discs 17, 21 relative to the inner surfaces 14, 24 of the cam plate 23 and the sprocket plate 12. The actuator 29 receives input from various engine sensors 41 and may be controlled by an engine control unit (ECU) 42 with controllers. The engine sensors 41 may sense position of the camshaft 26, position of the crankshaft, positions of the discs 17, 21, and other engine conditions.

When the sprocket plate 12 rotates, the cam plate 23 is also rotated in an opposite direction through the interface of the discs 17, 21 with the inner surface 14 of the sprocket plate 12 and the inner surface 24 of the cam plate 23. The axis of rotation 36 of the discs 17, 21 can be tilted by an actuator 29, such as a ball screw type actuator, so that the outer circumference 18, 22 of the discs 17, 21 themselves contact the inner surfaces 14, 24 of the cam plate 23 and the sprocket plate 12 at different distances from the cam axis of rotation R, which changes the speed of rotation of one plate relative to the other, changing the phase between the camshaft 26 and crankshaft (not shown).

Figure 5:
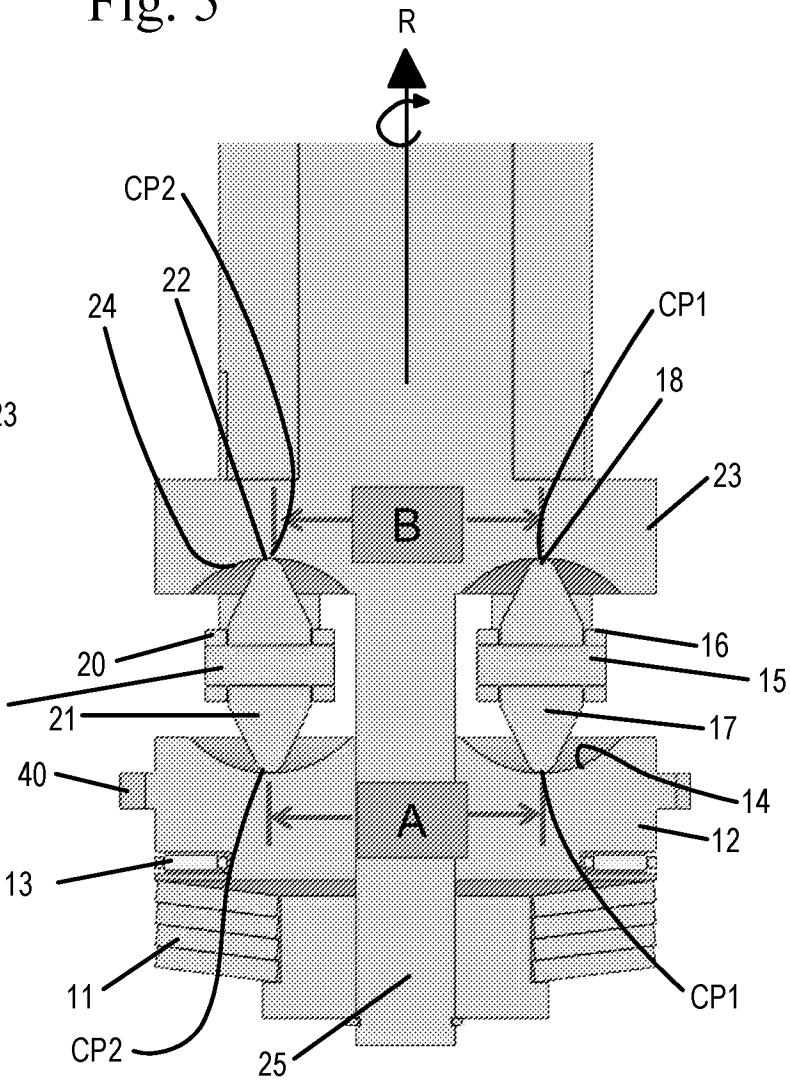
FIG. 5 shows a section of the friction drive of FIG. 4 in the holding position.
Figure 4:
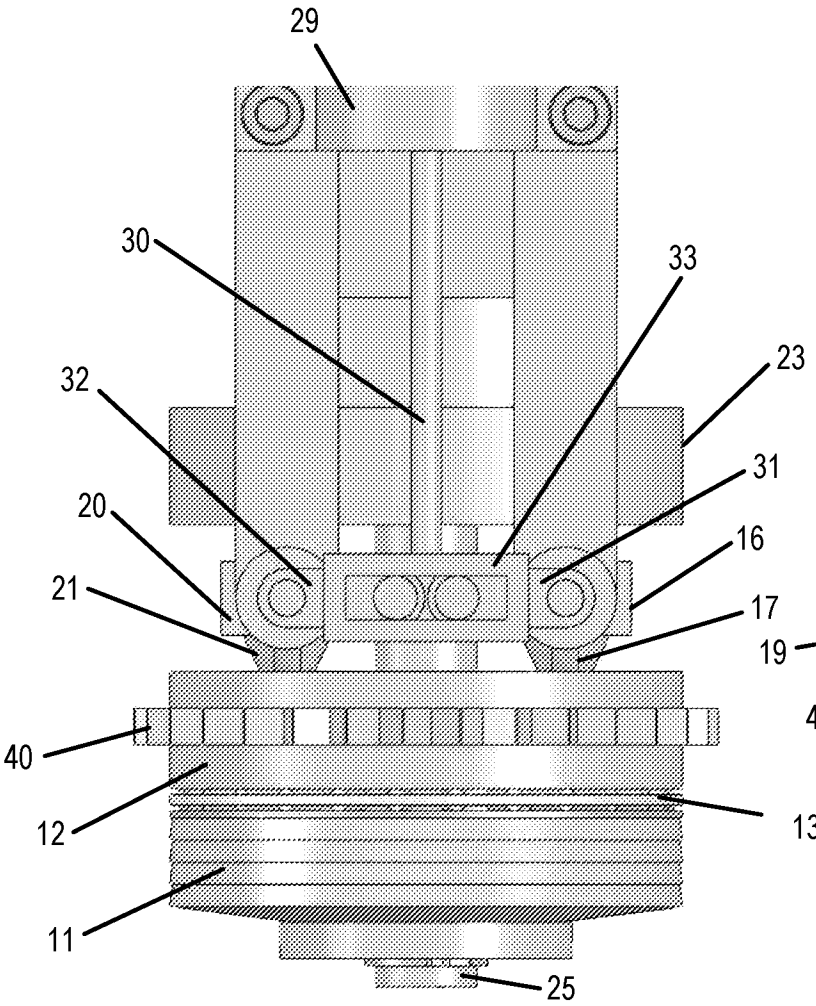
FIG. 4 shows a schematic of a friction drive in a holding position.
Figure 10A:
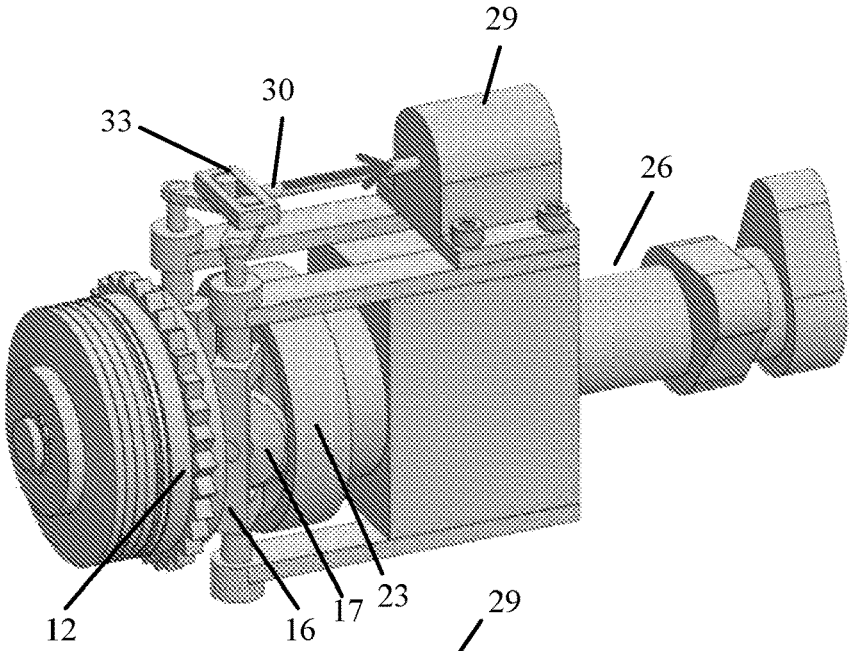
FIG. 10A shows the position of a linkage of the friction drive moving towards a retard position.
Figure 10B:
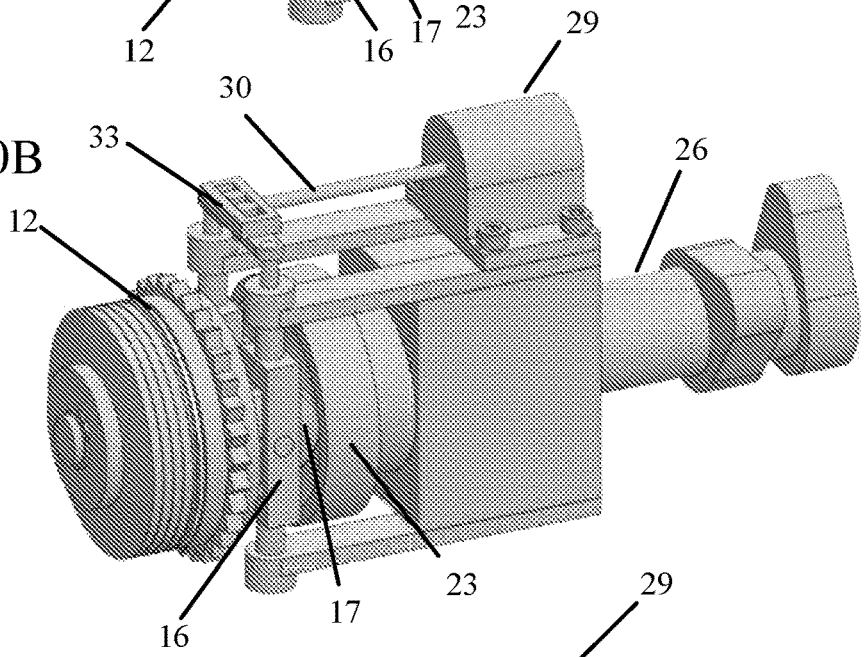
FIG. 10B shows the position of a linkage of the friction drive in a holding position.

Referring to FIGS. 4-5 and 10B, distance A is the distance between the contact points CP1, CP2 of the outer circumference 18, 22 of the discs 17, 21 with the inner surface 14 of the sprocket plate 12. Distance B is the distance between the contact points CP1, CP2 of the outer circumference 18, 22 of the discs 17, 21 with the inner surface 24 of the cam plate 23.

When the discs 17, 21 are aligned such that the axis of rotation 36 of the pins 15, 19 is perpendicular to the axis of rotation R of the camshaft 26, the distance A is approximately equal to distance B. In this configuration the cam plate 12 and the sprocket plate 12 are rotating at the same speed, and no phase change occurs between the camshaft 26 and the crankshaft (not shown). The phaser is thus in a holding position. It should be noted that the term "approximate" was used regarding distance A and distance B to account for slippage where the distance may be not be exactly equal.

Figure 7:
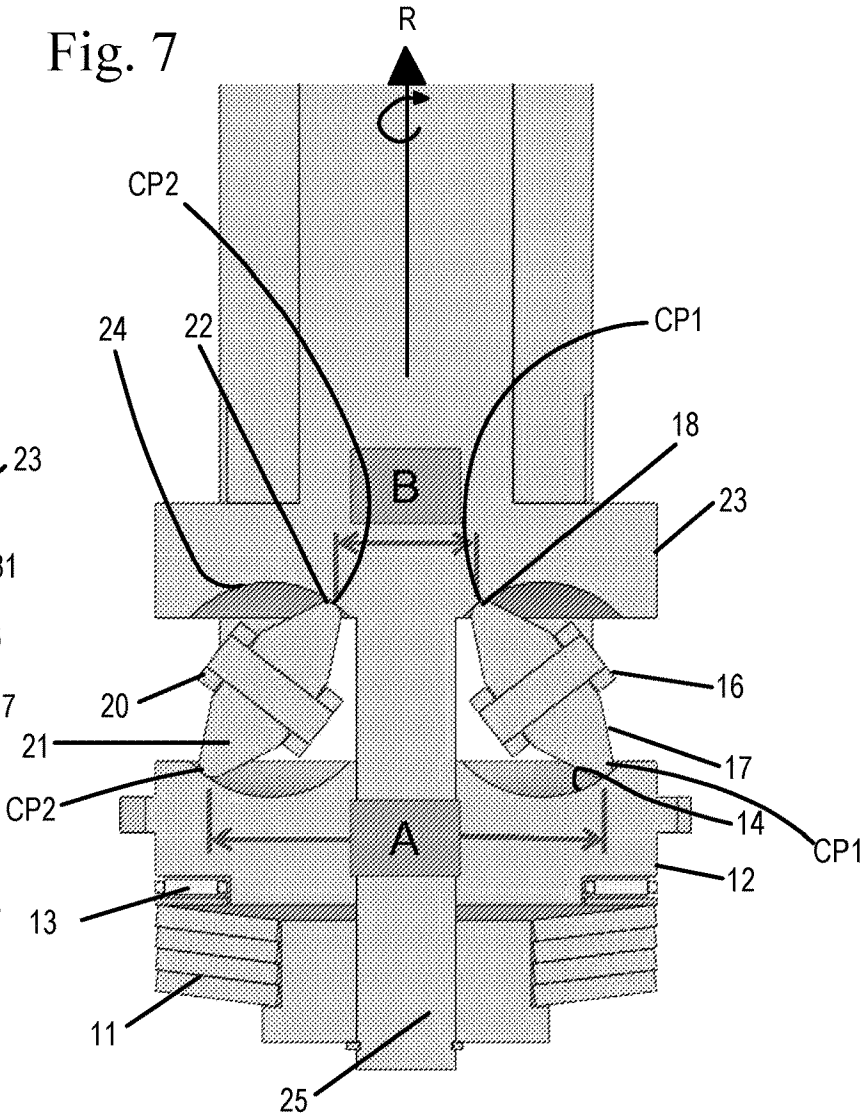
FIG. 7 shows a schematic of a friction drive of FIG. 6 moving towards an advance position.
Figure 6:
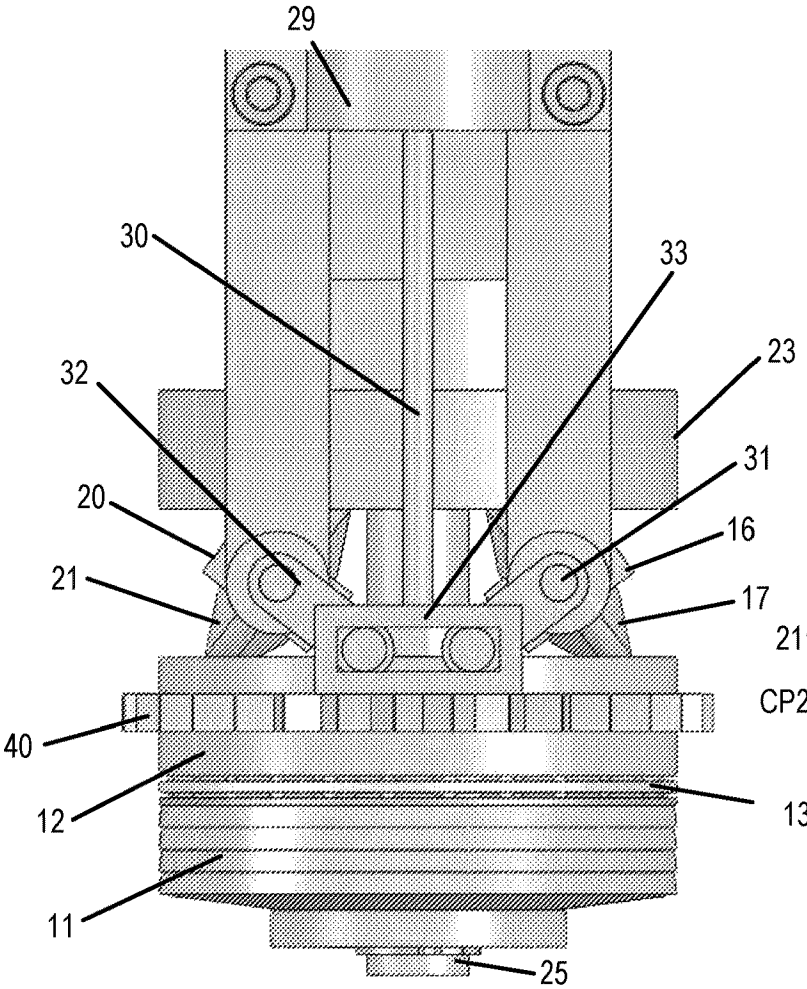
FIG. 6 shows a schematic of a friction drive moving toward an advance position.
Figure 10C:
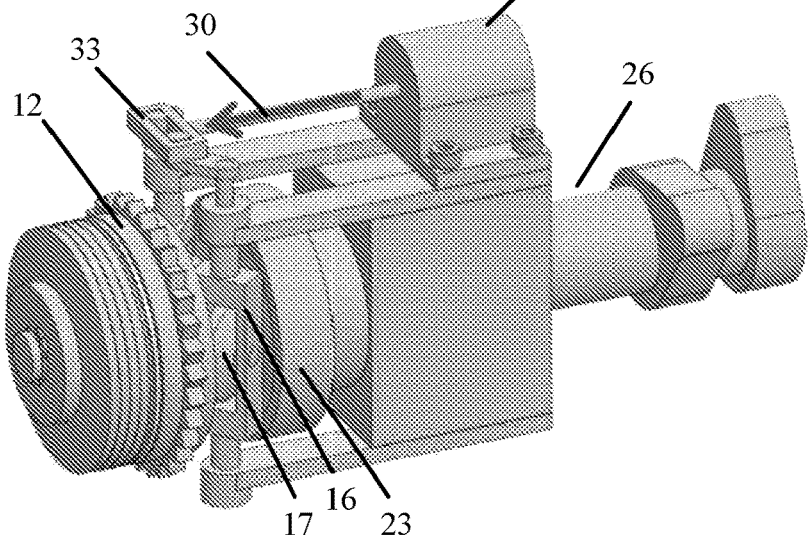
FIG. 10C shows the position of a linkage of the friction drive moving towards an advance position.

Referring to FIGS. 6-7 and 10C, in this position, the angle of the discs 17, 21 is such that the distance A is greater than distance B. With distance A being greater than distance B, due to the tilt of the discs 17, 21, rotating the sprocket plate 12 one revolution causes the cam plate 23 to be rotated more than one revolution, thus advancing the position of the camshaft 26 relative to the crankshaft (not shown).

Figure 9:
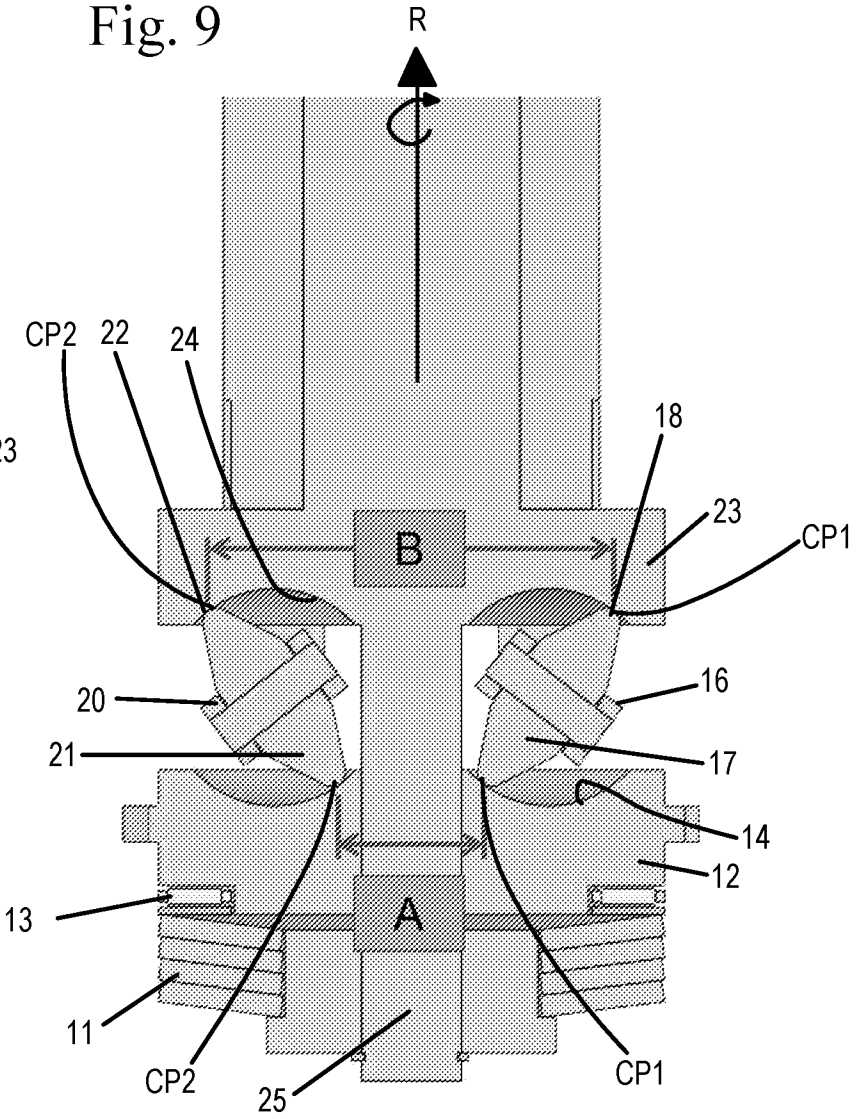
FIG. 9 shows a schematic of a friction drive of FIG. 8 moving towards a retard position.
Figure 8:
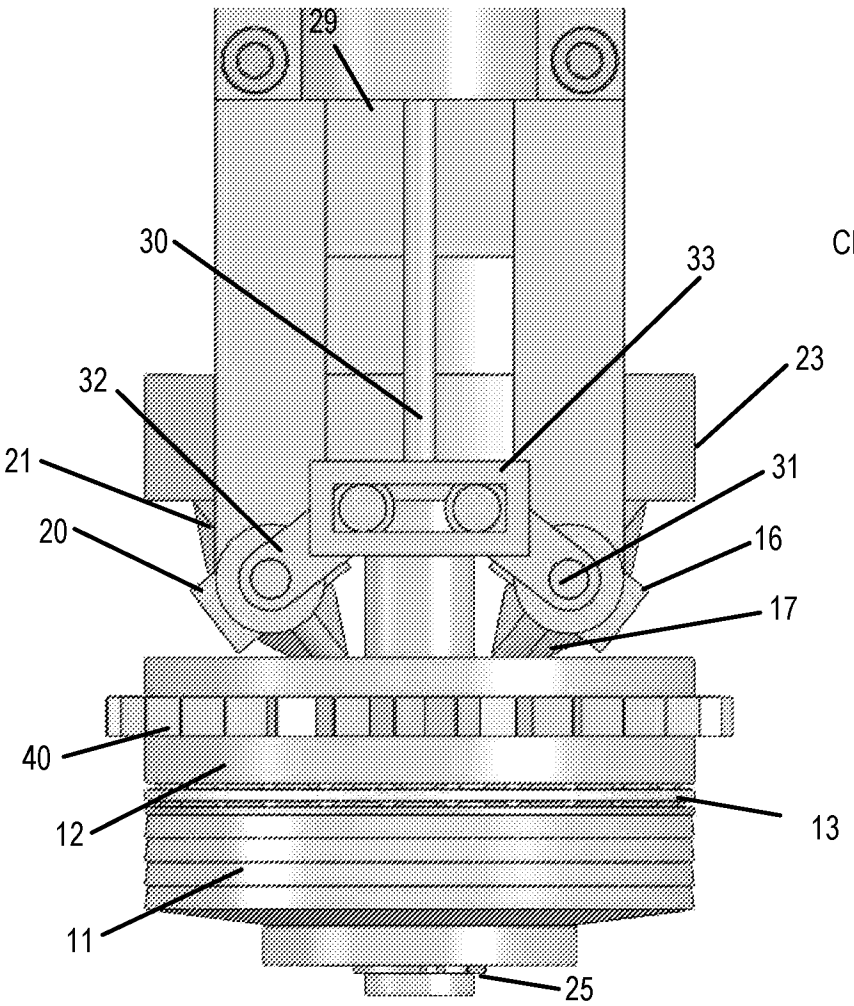
FIG. 8 shows a schematic of a friction drive moving towards a retard position.

Referring to FIGS. 8-9 and 10A, in this position, the angle of the discs 17, 21 is such that the distance A is less than distance B. With distance A being less than distance B, due to the tilt of the discs 17, 21, the sprocket plate 12 has to be rotated more than one rotation for the cam plate 23 to rotate one rotation, thus retarding the position of the camshaft 26 relative to the crankshaft (not shown).

It will be understood that in the situations noted above where distance A is not the same as distance B, the phaser will be operated such that the crankshaft and the camshaft rotate at different rates only long enough to change the phase of one versus the other, and then the phaser is reset so that distance A=B and the camshaft 26 and crankshaft (not shown) go back to rotating at the same speed. That is, the change of speed ratio between the two shafts is intended to be made only for a vanishingly short period of time, just long enough for the crankshaft (not shown) and camshaft 23 to change phase by a few degrees.

Figure 12:
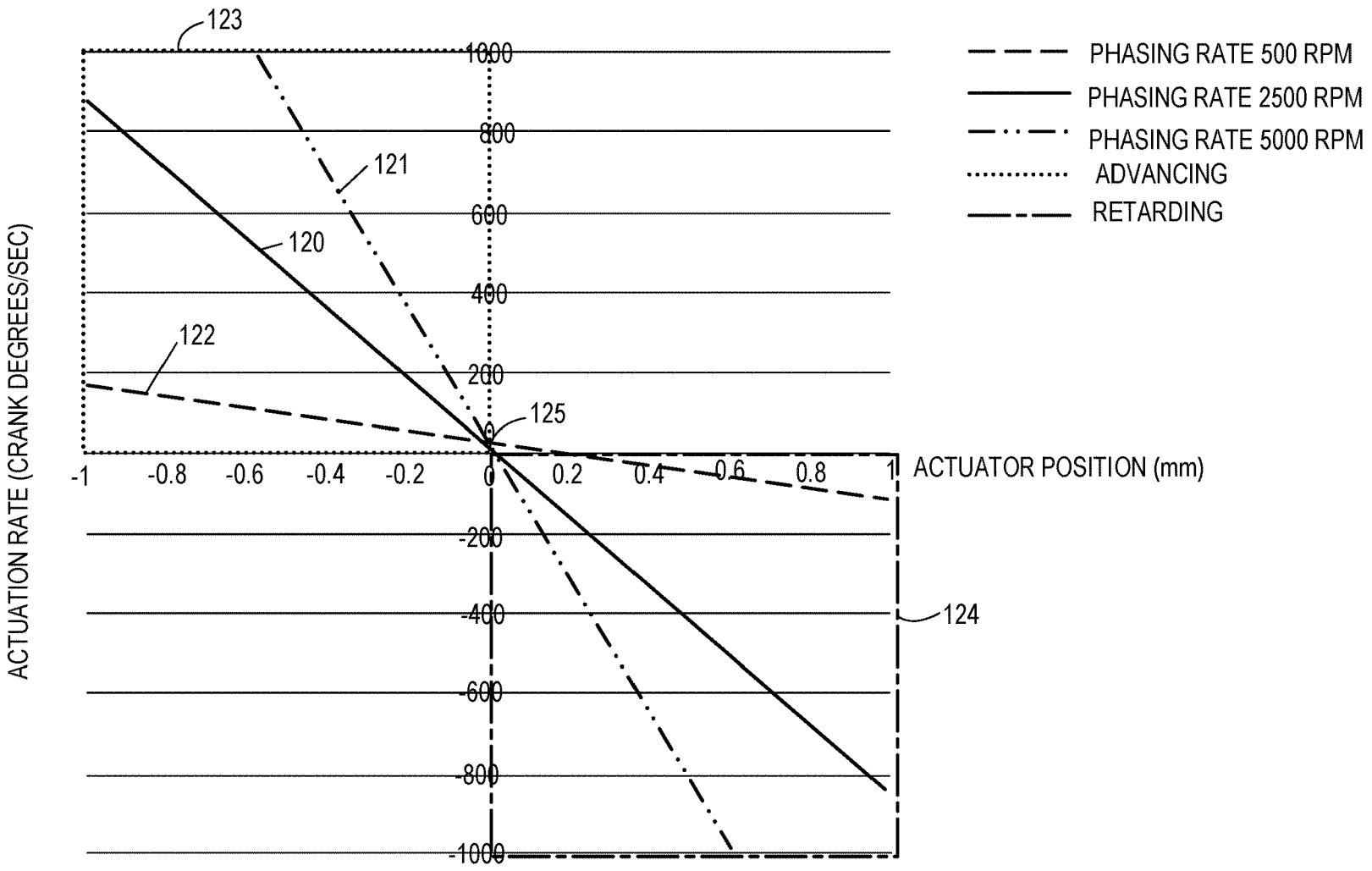
FIG. 12 shows a graph of actuation rate versus actuator linear position.

FIG. 12 shows a graph of rate of change of cam/crank phase ("phasing rate") versus actuator linear position. The values shown in FIG. 12 are for example purposes only.

The phasing rates at specific rpm are shown by a solid line 120, dashed line 122, and dash-dot-dot line 121. The dotted box 123 represents advancing the position of the camshaft relative to the crankshaft. The long dash-short dash box 124 represents retarding the position of the camshaft relative to the crankshaft.

At the origin of the graph 125, that is, a zero phasing rate and a zero actuator position, the phase of the camshaft does not change relative to crankshaft.

The graph of FIG. 12 shows how the advancing and retarding phasing rate of the camshaft relative to the crankshaft varies based on the engine rpm. The higher the engine rpm, the faster the rate of change when the actuator 29 alters the tilt of axis of rotation of the discs 17, 21 to a given position.

Figure 11:
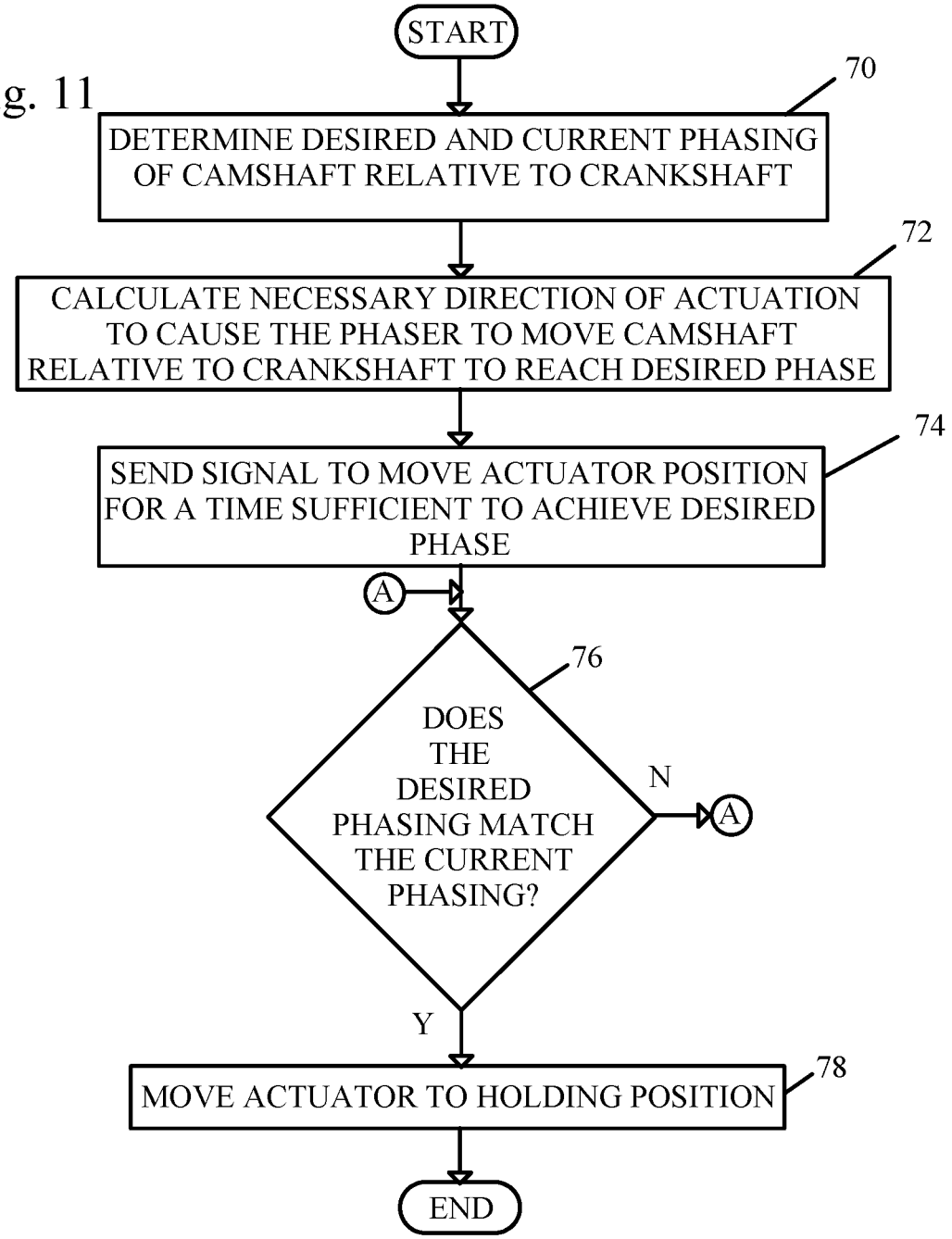
FIG. 11 shows a flow diagram of a method of adjusting the phase of a camshaft relative to a crankshaft by briefly changing the ratio of the friction drive.

FIG. 11 shows a flow diagram of a method of adjusting the phase of a camshaft relative to a crankshaft by briefly changing the ratio of the friction drive.

In a first step (step 70), the ECU 42 determines a desired phase of the camshaft 26 relative to the crankshaft based on engine conditions. The ECU 42 also determines the current position of the camshaft 26 relative to the crankshaft (not shown) through cam and crank sensors 41. The specific methods of determining desired phase and current phase are known to the art and do not form part of the invention. The engine conditions may include the load of the engine, crankshaft revolutions per minute (RPM), speed of the vehicle, throttle position, fuel flow, and other conditions as known to the art.

The ECU 42 calculates the necessary direction of actuation to cause the continuously variable friction drive or phaser 10 to move the camshaft 26 relative to the crankshaft in order to reach the desired phase of the camshaft 26 relative to the crankshaft (step 72). Preferably, the ECU 42 will also determine an actuator position to accomplish the change in phase in a desired time, taking into account the phasing rate relative to engine RPM as discussed and shown in FIG. 12.

The ECU 42 sends a signal to move the actuator 29 position for a time sufficient to achieve the desired phase (step 74). The actuator 29 would actuate rod 30 and the connector 33 to pivot or rotate the position of the carriers 16, 20 and thus the position of the discs 17, 21 relative to the inner surfaces of the cam plate 23 and the sprocket plate 12. The amount of movement of the actuator position can be determined from the known rate of change in phase relative to engine RPM, as in the example FIG. 12, above.

For example, suppose the engine RPM is 2500 and the desired phase is 5° advanced from the current position. At that RPM, according to FIG. 12, a movement of the actuator 29 to plus or minus 0.6 mm results in a phase change of 500° per second. With a desired shift of 5°, the desired phase shift can be accomplished by moving the actuator 29 to the negative 0.6 mm position for 0.01 seconds (5° divided by 500°/sec). If a faster or slower rate of change of phase is desired, the actuator can be moved more or less. In this example, the change is discussed as a step change (e.g. step to exact amount needed to make change) to certain position, it should be noted that the movement of the actuator 29 may also be ramped up or down to achieve the change as needed as well.

Once the desired phasing the camshaft 26 relative to the crankshaft (not shown) is reached (step 76), the actuator 29 position is moved to a holding position in which the camshaft 26 and crankshaft rotate at the same speed in different directions (step 78) and the method ends.

Determining that the desired phasing of the camshaft 26 relative to the crankshaft (not shown) has been reached can be determined based on a calculation of phase rate at the current engine RPM and actuator position. In other words, the ECU 42 could just move the actuator for a determined period of time, then put it back in the holding position. Preferably, however, the desired phasing of the camshaft 26 relative to the crankshaft has been reached would be determined by actual measurement by reading cam and crank positions from the sensors providing input to the ECU 42.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method of adjusting a phase of a camshaft relative to a crankshaft by use of a variable-ratio friction drive phaser having an actuator which changes a tilt of a plurality of discs transmitting power between a cam plate coupled to the camshaft and a sprocket plate coupled to the crankshaft, comprising the steps of:

a) a controller determining a desired phase and a current phase of the camshaft relative to the crankshaft;

b) the controller calculating an actuation direction to move the actuator to change the phase of the camshaft relative to the crankshaft from the current phase to the desired phase;

c) the controller sending a signal to the actuator to adjust the tilt of the plurality of discs to a determined position in the calculated actuation direction to advance or retard the camshaft relative to the crankshaft; and d) the controller sending a signal to the actuator to return the tilt of the plurality of discs to a holding position in which the phase of the camshaft relative to the crankshaft is maintained at the desired phase.

2. The method of claim 1, in which step (d) is performed after an elapsed time calculated based on a known rate of change in phase at the determined position at a current engine rpm.

3. The method of claim 1, further comprising the step, after step (c), of measuring an actual phase of the camshaft to the crankshaft, and in which step (d) is performed after the actual phase reaches the desired phase.

4. The method of claim 1, in which the friction drive phaser comprises:

the cam plate having a curved inner surface;

the sprocket plate having a curved inner surface;

the cam plate and the sprocket plate arranged such that the inner surface of the cam plate is arranged to be parallel to the inner surface of the sprocket plate, the inner surface of the sprocket plate and the inner surface of the cam plate forming a cavity;

a plurality of carriers received within the cavity, each carrier comprising a disc of the plurality of discs with an outer circumference with a first contact point in contact with the inner surface of the sprocket plate and a second contact point in contact with the inner surface of the cam plate, the disc being pivotable to adjust an angle of the disc relative to the inner surfaces of the sprocket plate and the cam plate; and the actuator mechanically connected to the plurality of carriers and receiving input from the controller to pivot the plurality of discs to move the first contact point and the second contact point and the second contact point relative to the inner surfaces of the sprocket plate and the cam plate.

* * * * *